US008418803B2

(12) United States Patent
Findlay

(10) Patent No.: US 8,418,803 B2
(45) Date of Patent: Apr. 16, 2013

(54) FLASH SUPPRESSOR

(75) Inventor: David Findlay, Athol, MA (US)

(73) Assignee: Smith & Wesson Corporation, Springfield, MA (US)

( * ) Notice: Subject to any disclaimer, the term of this patent is extended or adjusted under 35 U.S.C. 154(b) by 0 days.

(21) Appl. No.: 13/287,544

(22) Filed: Nov. 2, 2011

(65) Prior Publication Data

US 2012/0228052 A1 Sep. 13, 2012

Related U.S. Application Data

(60) Provisional application No. 61/410,043, filed on Nov. 4, 2010.

(51) Int. Cl.
*F41A 21/00* (2006.01)

(52) U.S. Cl.
USPC ..... 181/223; 89/14.4

(58) Field of Classification Search ..... 181/223; 89/14.4
See application file for complete search history.

(56) References Cited

U.S. PATENT DOCUMENTS

| | | | | |
|---|---|---|---|---|
| 2,322,370 | A | 6/1943 | Lance | |
| 3,710,683 | A | 1/1973 | Kaltmann | |
| 4,392,413 | A | 7/1983 | Gwinn, Jr. | |
| 4,869,151 | A * | 9/1989 | Chahin | 89/14.3 |
| 4,893,544 | A | 1/1990 | Hawley et al. | |
| 5,063,827 | A | 11/1991 | Williamson | |
| 5,092,223 | A * | 3/1992 | Hudson | 89/14.2 |
| 6,425,310 | B1 * | 7/2002 | Champion | 89/14.3 |
| 7,059,235 | B2 | 6/2006 | Hanslick et al. | |
| 7,308,967 | B1 * | 12/2007 | Hoel | 181/223 |
| 7,870,815 | B2 * | 1/2011 | Hung | 89/14.2 |
| 7,905,170 | B1 | 3/2011 | Brittingham et al. | |
| 8,162,100 | B2 * | 4/2012 | Shults et al. | 181/223 |
| 2004/0173403 | A1 * | 9/2004 | Shafer | 181/223 |
| 2010/0163336 | A1 * | 7/2010 | Presz et al. | 181/223 |
| 2012/0180352 | A1 * | 7/2012 | Addis | 42/1.06 |

OTHER PUBLICATIONS

Photograph (date unknown) illustrating a muzzle brake on a BSA Rifle.

* cited by examiner

*Primary Examiner* — Forrest M Phillips
(74) *Attorney, Agent, or Firm* — Ballard Spahr LLP

(57) ABSTRACT

A muzzle device for use on a firearm to reduce noise signature and muzzle flash includes a cylindrical housing. The cylindrical housing defines a first chamber and a second chamber with a longitudinal axis extending therethrough. The first chamber has at least one port that extends outward therefrom. The second chamber has at least one slot that extends outward therefrom. The at least one port forms an acute angle with the longitudinal axis that extends forward toward the slot. The angle formed by the at least one port and the longitudinal axis being about 50 degrees. The cylindrical housing defines an outer annular groove being in communication with the at least one port. The at least one port is in communication with an aft surface of the annular groove.

31 Claims, 8 Drawing Sheets

FLASH SUPPRESSOR

CROSS REFERENCE TO RELATED APPLICATION

This application claims the benefit of U.S. Provisional Application No. 61/410,043, filed Nov. 4, 2010, entitled "MUZZLE BRAKE", the aforementioned application being hereby incorporated by reference in its entirety.

FIELD OF THE INVENTION

The present invention relates generally to firearms and, more particularly, to a flash hider muzzle device or muzzle brake for firearms that reduces the noise signature of the firearm, concussion, perceived recoil of the firearm, dust signature of the firearm, and muzzle flash.

BACKGROUND OF THE INVENTION

When a firearm is discharged, the propellant gases that eject the projectile out of the muzzle of the firearm accumulate behind the projectile and, upon exiting the firearm, create a recoil force back towards the shooter. In higher-powered rifles this recoil force may cause discomfort and fatigue to the shooter. In certain cases, this perceived recoil force is sharp and heavy enough to affect the shooter's accuracy. It is desirable, therefore, to provide a firearm having the capability of reducing the recoil force perceived by the shooter.

This discharge of propellant gases may also cause the muzzle end of the barrel to undesirably rise up subsequent to firing. This rising up or climbing effect of the muzzle end of the barrel is commonly known as "muzzle rise" or "muzzle climb." The primary reason for muzzle climb is the inherent configuration of most firearms. In the majority of firearms, the firing axis of the barrel is above the center of contact between the shooter and the firearm's grip and stock. The forces generated from the projectile being fired, and the propellant gases exiting the muzzle, act directly down the barrel/firing axis of the firearm, back toward the shooter. If this force is above the center of the shooter's contact point on the firearm, this creates a torque, which causes the firearm to rotate about the point of contact and the muzzle end of the barrel to rise upwards.

Muzzle climb is especially undesirable in instances where multiple rounds of ammunition are fired in quick succession, due to the tendency of the firearm to be completely misaligned with respect to the target. As a result of muzzle climb in such instances, the firearm must be re-aimed at the target after each shot as quickly as possible to ensure accuracy. As will be readily appreciated, such re-aiming can cost the shooter precious time. It is desirable, therefore, to provide a firearm where muzzle climb is substantially eliminated or directionally controlled so as to aid, rather than hamper, efficient and accurate rapid firing.

In addition to the above, other undesirable discharge effects are noise and muzzle flash. As a firearm is discharged and a projectile exits the muzzle end of the barrel, hot, high pressure gases are also released from the muzzle behind the projectile. This release of gases is known as muzzle blast. Muzzle flash is the term used to describe the light emitted during the muzzle blast, which can be both visible and infrared. The blast and flash are caused by the combustion products of the gunpowder, and any remaining unburned powder, mixing with ambient air. The size and shape of the muzzle flash is dependent on the type of ammunition being used and the individual characteristics of the firearm.

This discharge of combustion gases also results in a loud noise or concussion propagating in all directions. This noise may be injurious to the shooter and may also be heard by persons or listening devices around the shooter, thereby potentially giving away a shooter's position. It is desirable, therefore, to provide a firearm whose noise signature, concussion, and flash signature is substantially reduced.

To reduce the aforementioned undesirable effects of discharge, "muzzle devices" such as a muzzle brake, may be employed in combination with a firearm. Most known muzzle devices comprise an attachment secured to the muzzle end of a firearm to reduce recoil by redirecting and dissipating propellant gases radially away from the direction of the barrel of the firearm through a series of openings within the attachment. In redirecting the propellant gases to the side and upward from the barrel, some of the gases are directed to the side and rearward towards the shooter. Thus, firearms equipped with conventional muzzle devices can sound much louder to the shooter than the same firearm with no muzzle device. Hence, one must choose a either a firearm with substantial recoil force or firearm with a muzzle device that exhibits increased noise. What is needed, therefore, is a muzzle device that functions to reduce the recoil force felt by the shooter without a substantial increase in noise perceived by the shooter or concussion to those near the shooter.

In addition, while there are known muzzle devices that optimize flash suppression, such muzzle devices are not good for optimizing noise suppression or concussion. Likewise, while there are known muzzle devices that optimize noise suppression, such muzzle devices are not sufficient to optimize flash suppression. As will be readily appreciated by one of ordinary skill in the art, and as evidenced by existing muzzle devices, it is difficult to optimize both flash suppression, concussion, and noise suppression simultaneously. Accordingly, there is a need for an improved muzzle device that can accomplish these sometimes competing objectives simultaneously.

Finally, known firearms, and even firearms with muzzle devices, also tend to create a dust signature when fired, especially when fired in the prone position. As the pressure wave ahead of the projectile propagates in all directions, and as propellant gases behind the projectile exit the muzzle end of the barrel behind the bullet and combust, they impact the ground and kick up dust, dirt and other particulate matter, thereby potentially revealing and compromising the shooter's position. This is especially undesirable in military operations or other instances in which the shooter must remain concealed from the target or others around him.

In view of the problems associated with known firearms and known muzzle devices, there is a need for an improved muzzle device for use with a firearm that reduces the recoil, muzzle flash, noise signature, concussion, and dust signature of the firearm with which it is used.

SUMMARY OF THE INVENTION

In view of the foregoing, it is an object of the present invention to provide a muzzle device for use with a firearm that reduces the noise signature of the firearm.

It is another object of the present invention to provide a muzzle device for use with a firearm that reduces the perceived recoil of the firearm.

It is another object of the present invention to provide a muzzle device for use with a firearm that reduces muzzle climb.

It is another object of the present invention to provide a muzzle device for use with a firearm that reduces muzzle flash.

It is another object of the present invention to provide a muzzle device for use with a firearm that optimizes muzzle flash suppression, concussion, and noise suppression simultaneously.

It is another object of the present invention to provide a muzzle device for use with a firearm that reduces the dust signature of the firearm, especially when the firearm is fired from the prone position.

It is another object of the present invention to provide a muzzle device for use with a firearm that aids in protecting the operator when firing the firearm into glass or other material at close range.

According to one aspect of the preferred embodiment of the present invention, there is provided a muzzle device having a generally cylindrical housing adapted for attachment to the muzzle of a firearm. Alternatively, the muzzle device may be integrally formed with the barrel of the firearm. The housing generally defines at least one, but preferably two, internal chambers for permitting passage and exit of a projectile. The housing is further formed to define a plurality of vent ports which collectively define a desired chamber bleed off area.

BRIEF DESCRIPTION OF THE DRAWINGS

The accompanying drawings, which are incorporated in and constitute a part of this specification, illustrate embodiments of the disclosure, and together with a general description of the disclosure given above, and the detailed description of the embodiments given below, serve to explain the principles of the disclosure.

Other features and advantages of the present disclosure will become apparent from the following detailed description, taken in conjunction with the accompanying drawings, which illustrate, by way of example, the principals of the invention.

DETAILED DESCRIPTION OF THE PREFERRED EMBODIMENTS

As used herein, the directional terms "front," "forward," "rear," "rearward," "upward," "downward," "right," "left," "top" and "bottom" refer to the firearm when held in the normal firing position, as would be understood by one of ordinary skill in the art.

Figure 1:
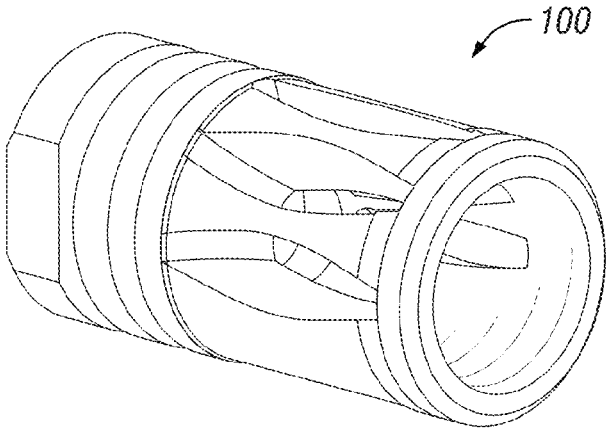
FIG. 1 (Prior Art)
FIG. 1 is a perspective view of a prior art muzzle device.
Figure 2:
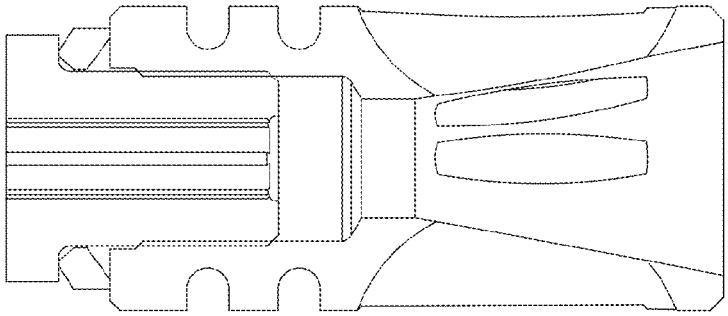
FIG. 2 (Prior Art)
FIG. 2 is a cross-sectional view of the prior art muzzle device of FIG. 1.
Figure 3:
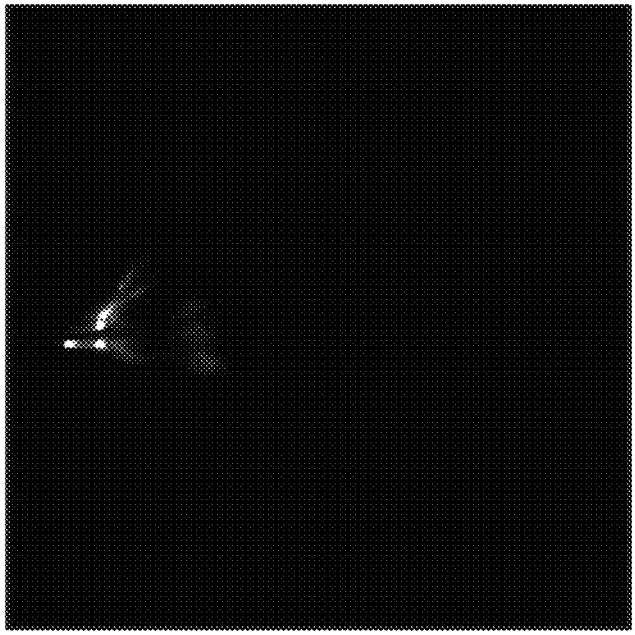
FIG. 3 (Prior Art)
FIG. 3 is a high-speed movie picture showing the flash signature of the prior art muzzle device of FIG. 1.
Figure 4:
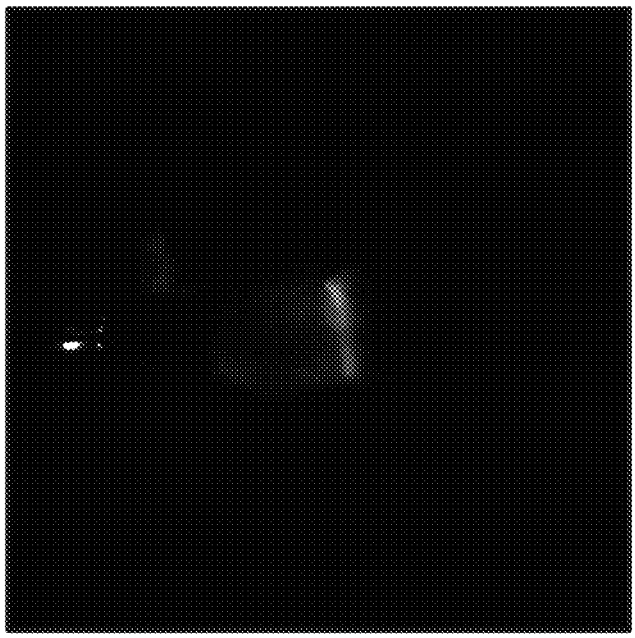
FIG. 4 (Prior Art)
FIG. 4 is a high-speed movie picture showing the flash signature of the prior art muzzle device of FIG. 1.
Figure 5:
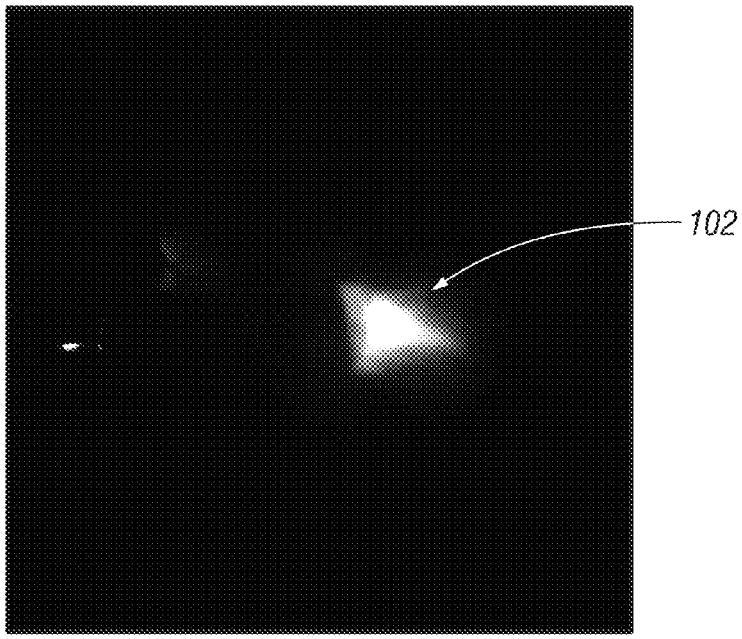
FIG. 5 (Prior Art)
FIG. 5 is a high-speed movie picture showing the flash signature of the prior art muzzle device of FIG. 1.
Figure 6:
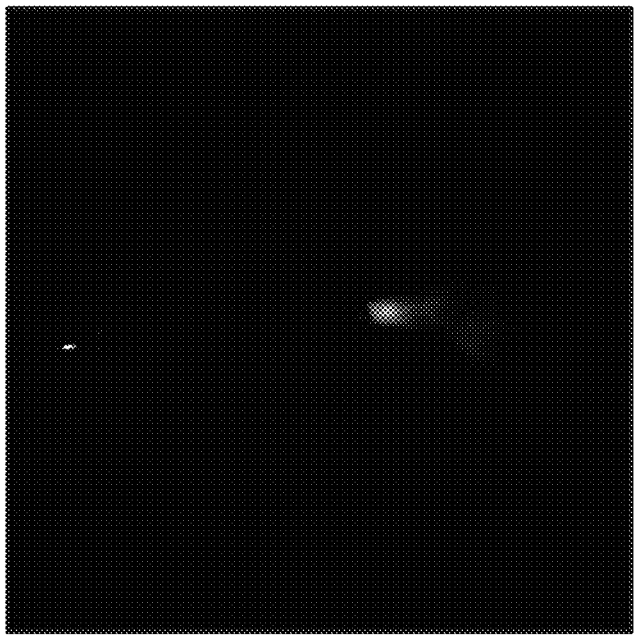
FIG. 6 (Prior Art)
FIG. 6 is a high-speed movie picture showing the flash signature of the prior art muzzle device of FIG. 1.

A prior art muzzle device 100 for a M4/M16 line of rifles is shown in FIGS. 1 and 2. As shown therein, the muzzle device 100 projects powder gases to the top and directly to the sides to reduce recoil and muzzle rise through the use of slots. In doing so, however, other personnel to the side of the rifle experience substantial noise and concussion as the rifle is being fired from the escaping powder gases. While muzzle device 100 does reduce flash as compared to a bare muzzle with no flash suppressor, there is a need to have the flash reduced even more to conceal the shooter from enemy personnel when firing at night. As will be readily appreciated, improved flash suppression aids night vision equipment operation. The prior art muzzle device 100, shown in FIGS. 1 and 2, also experiences a second flash or "bloom" 102, as best shown in FIG. 5, several inches in front of the muzzle. As will be readily appreciated, the bloom is very undesirable, as it can reveal a shooter's position. The bloom is caused by the burning of the high pressure combustion gases that trail the projectile and expand outwards from the muzzle of the firearm. The burning of these combustion gases in front of the muzzle also creates a loud noise, which is also undesirable, as discussed above. The flash signature of the prior art muzzle device is shown in FIGS. 3-6.

Figure 7:
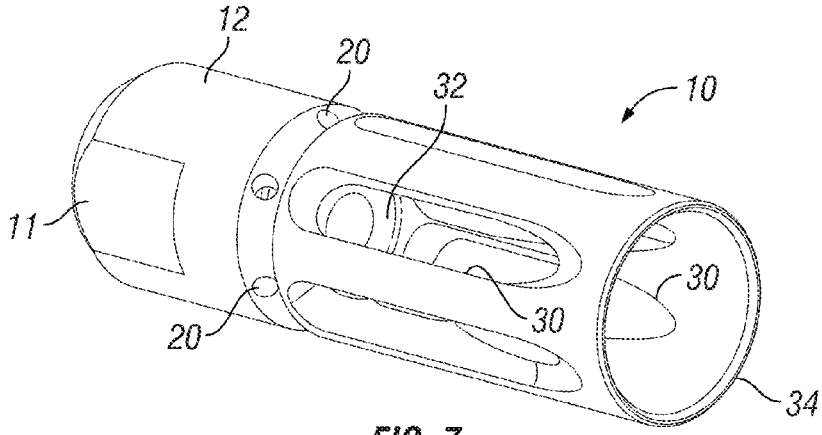
FIG. 7 is a perspective view of a muzzle device in accordance with one embodiment of the present invention.
Figure 8:
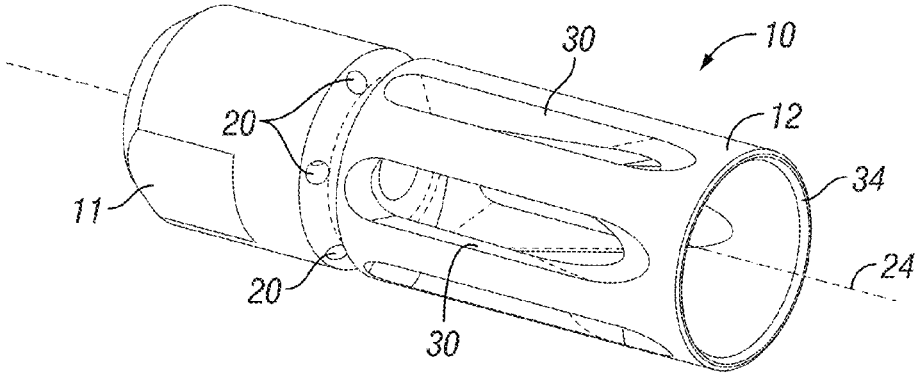
FIG. 8 is a perspective view of the muzzle device of FIG. 7 showing a top and right side thereof.
Figure 9:
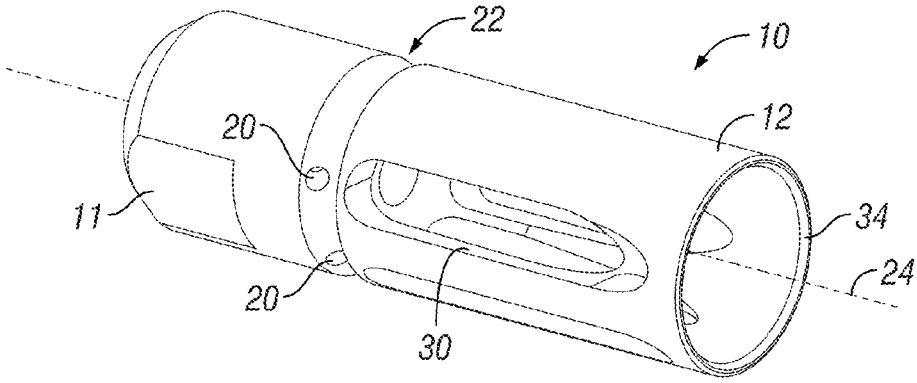
FIG. 9 is a perspective view of the muzzle device of FIG. 7 showing a bottom and left side thereof.
Figure 14:
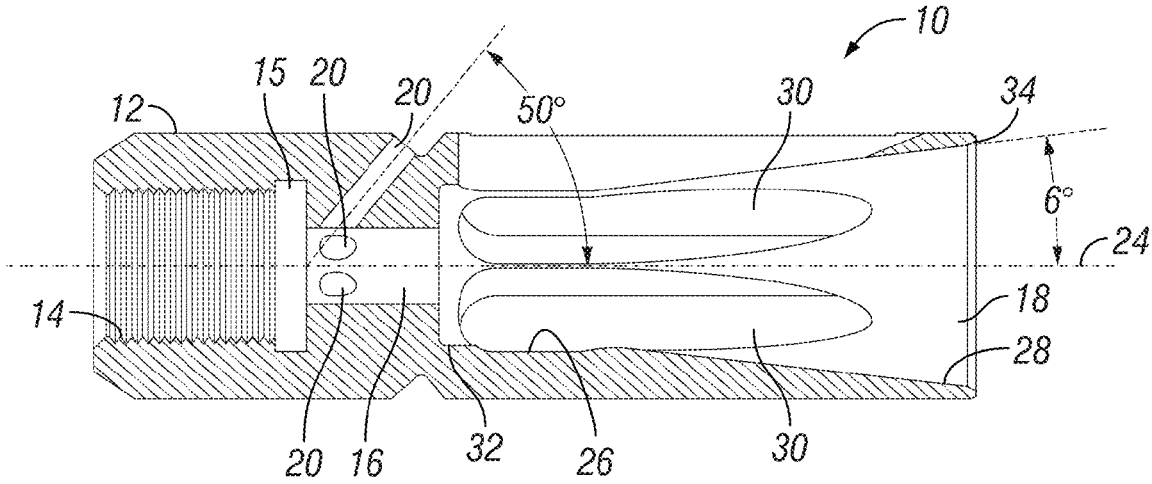
FIG. 14 is a cross-sectional view of the muzzle device taken along line 14-14 of FIG. 12.
Figure 19:
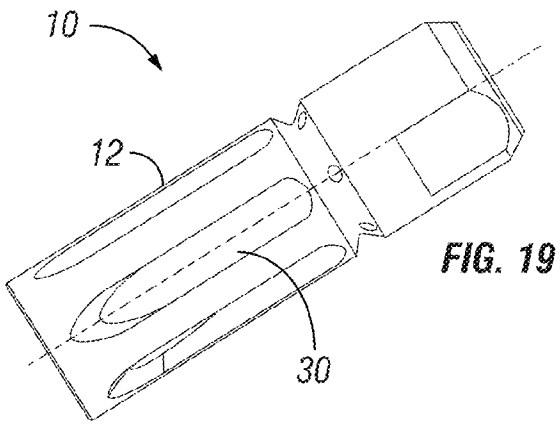
FIG. 19 is a side plan view of the muzzle device taken along line 19-19 in FIG. 7.
Figure 18:
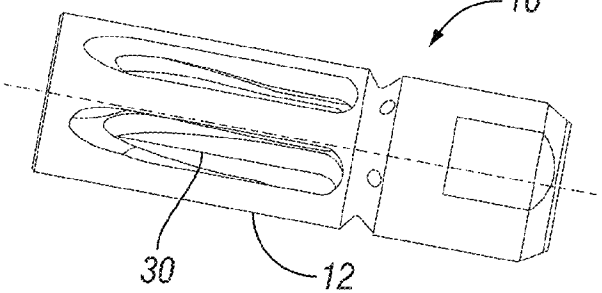
FIG. 18 is an upper plane view of the muzzle device taken along line 18-18 in FIG. 7.
Figure 15:
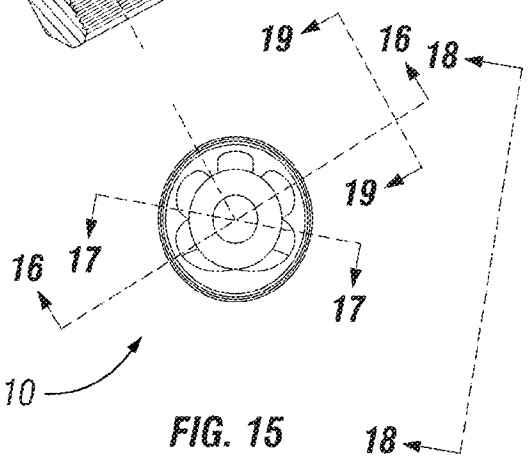
FIG. 15 is a front plane view of the muzzle device of FIG. 7.
Figure 16:
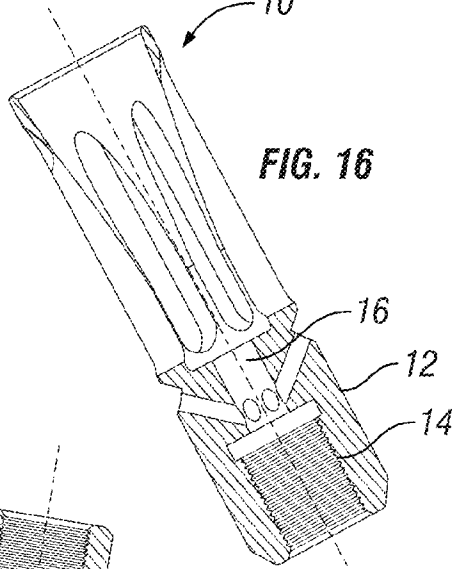
FIG. 16 is a sectional view of the muzzle device taken along line 16-16 in FIG. 7.
Figure 17:
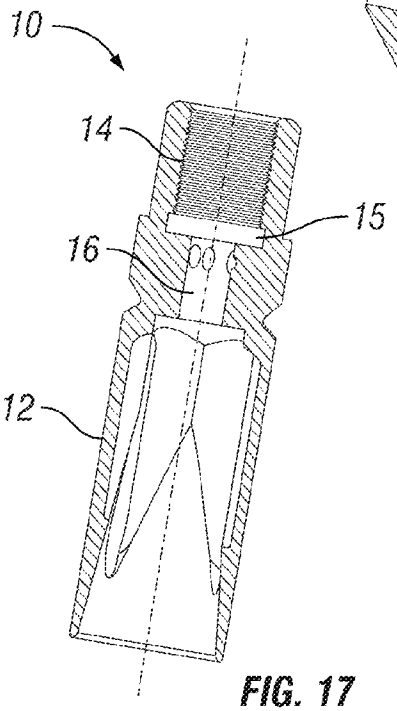
FIG. 17 is a sectional view of the muzzle device taken along line 17-17 in FIG. 7.

Referring generally to FIGS. 7-19, a muzzle device 10 according to one embodiment of the present invention is shown. As shown therein, the muzzle device 10 comprises a generally cylindrical housing 12 having a first (or rearward) end, which is adapted to be threaded or otherwise attached to the muzzle portion of a barrel of a firearm, and a second (or forward) end. Preferably, the first end of the muzzle device 10 is provided with a female threaded engagement means 14, as shown in FIG. 14, for engaging a complimentary male threaded engagement means (not shown) on the muzzle end of a barrel of a firearm (not shown). As will be readily appreciated, the male and female threaded engagement means may be male and female threaded portions, respectively, although other joining or attachment means known in the art may be used. Alternatively, however, the muzzle device 10 may be integrally formed with the barrel of the firearm. Moreover, while the muzzle device 10 of the present invention is preferably cylindrical in shape, although any shape that accomplishes the intended purpose may be used. As best shown in FIGS. 7-9, the first end of the muzzle device 10 is provided with flats 11, that provide a surface which a wrench or the like can engage to secure the muzzle device 10 to the muzzle of a firearm.

With reference to FIG. 14, the generally cylindrical housing 12 defines two internal chambers, a first chamber 16 located nearest to the threaded engagement means 14, and a second chamber 18 located adjacent the distal end of the muzzle device 10 and opposite the threaded engagement means 14. As shown therein, the first chamber 16 is generally cylindrical in shape and is sized so as to permit passage of a projectile there through. In the preferred embodiment, for use with the M4 family of firearms in which the ammunition used is 5.56×45 mm NATO ammunition (or 0.223 Remington ammunition) the diameter of the first chamber 16 is approximately 0.25 inches. It will be readily appreciated, however, that this dimension may be varied depending on the particular firearm with which the muzzle device 10 is intended to be used and the caliber of ammunition to be fired therefrom. In any case, it is preferred that the diameter of the first chamber 16 closely match the caliber of the ammunition used.

Figure 10:
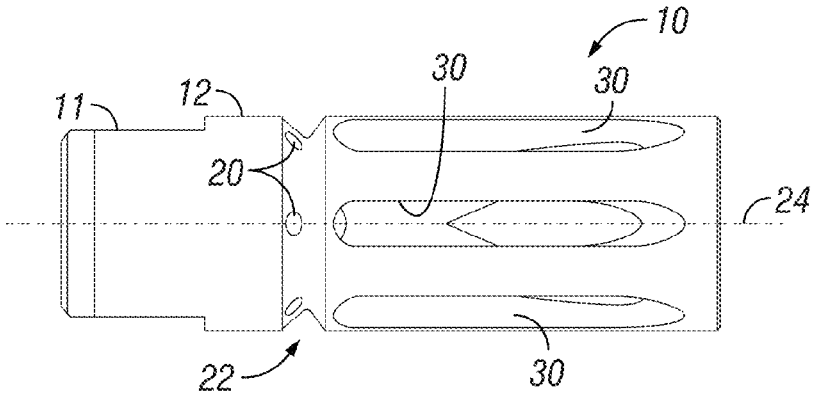
FIG. 10 is a top plan view of the muzzle device of FIG. 7.
Figure 11:
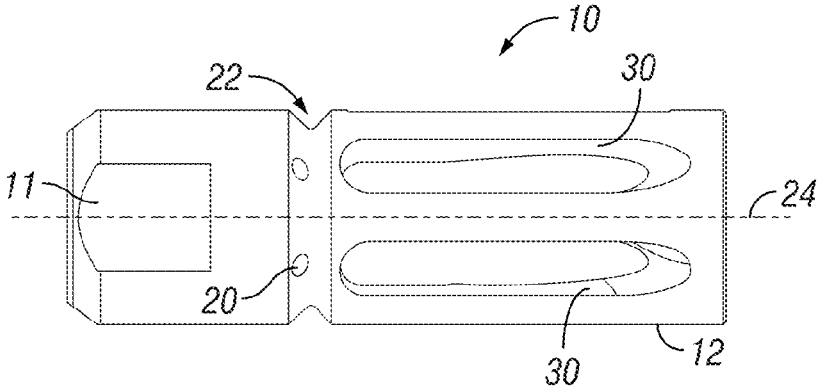
FIG. 11 is a right side view of the muzzle device of FIG. 7.
Figure 12:
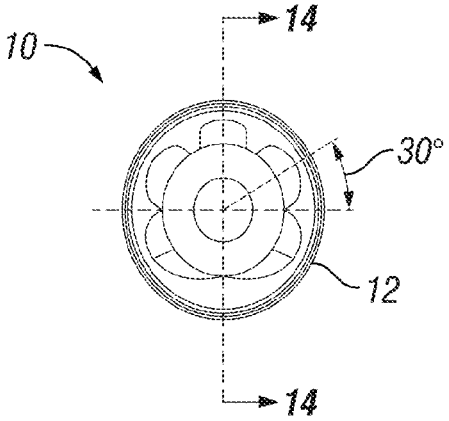
FIG. 12 is a front plane view of the muzzle device of FIG. 7.
Figure 13:
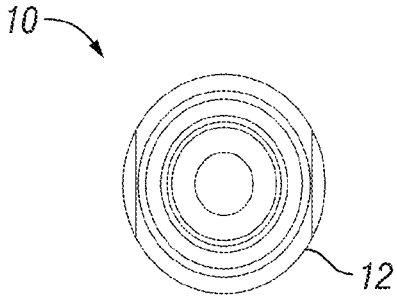
FIG. 13 is a rear plane view of the muzzle device of FIG. 7.

As further shown in FIGS. 7-9 and 14 a plurality of ports 20 extend from the first chamber 16 to ambient air at an approximate forward angle of 50 degrees. The ports are preferably cylindrical in shape, have a diameter of approximately 0.094 inches and are reduced in length. As shown therein, there are preferably 5 ports arranged radially along the periphery of the housing 12 of the muzzle device. A first port 20 is positioned at an uppermost portion of the muzzle device, to direct combustion gases substantially upwards and forwards. A pair of ports 20 are positioned to either side of this first port 20 such that each of the ports 20 are spaced approximately 30 degrees apart from one another, as shown in FIG. 12. As best shown in FIGS. 10 and 11, the exit opening of the ports 20 are positioned within an annular groove 22 provided in the housing 12. As will be readily appreciated, the presence of this annular groove 22 has the effect of shortening the length of the ports 20 to a length that is shorter than would otherwise be the case without the groove 22. It has been found that the shortened length of the ports 22 optimizes both flash suppression and noise suppression simultaneously, by dispersing and breaking up the combustion gas/fuel mixture to substantially prevent detonation and production of a secondary flash or substantial noise, as discussed in detail below. That is, the reduced length and orientation of the ports 22 has been found to be optimal to disrupt the combustion gas mixture to substantially prevent detonation and, therefore, flash and noise.

Importantly, as discussed in detail below, and as best shown in FIG. 9, there are no ports 20 oriented along a bottom portion of the muzzle device 12. It will be readily appreciated that while five ports 20 are used in the preferred embodiment, more or less than five ports may also be used.

As shown in FIG. 14, the second chamber 18 has a first section 26 of generally cylindrical shape and a second section 28 of a generally tapered cone shape. The first section 26 is located adjacent the first chamber 16. In the preferred embodiment, the first section 26 is approximately 0.520 inches in diameter and is approximately 0.50 inches in length. The second section 28 is located adjacent the first section 26 and extends from the first section 26 to the distal end of the muzzle device 10. In the preferred embodiment, the second section 28 is approximately 1.250 inches in length. As best shown in FIG. 14, the walls of the second section 28 extend at an angle of approximately 6 degrees relative to the longitudinal axis 24 of the muzzle device 10. At its narrowest point, adjacent the first section 26, the second section 28 of the second chamber 18 is approximately 0.520 inches in diameter. At its widest point, adjacent the distal end of the muzzle device 10, the second section 28 is approximately 0.864 inches in diameter.

As best shown in FIGS. 7-11 and 14-19, the second chamber 18 has a plurality of slot openings 30 that extend through the cylindrical body 12 from the second chamber 18 to ambient air. Preferably, the plurality of slot openings 30 of the second chamber 18 are in longitudinal alignment with the ports 20 of the first chamber 16. That is, in the preferred embodiment, a first slot opening 30 is aligned longitudinally on the extreme top of the muzzle device 10 with the first port 20 and the first, while a pair of slot openings 30 are disposed to either side of the first slot opening 30 and spaced apart equidistant at an angle of approximately 30 degrees. As with the ports 20, there are preferably 5 slot openings 30. Preferably, the slot openings 30 are ovular in shape, having a longitudinal aspect and a lateral aspect, with the longitudinal aspect being greater than the lateral aspect, although other shapes such as square, circular and the like are possible. In the preferred embodiment, the lateral aspect of the slot openings 30 ranges from approximately 0.188 inches to 0.250 inches. The forward most portion of the slot openings 30 terminates approximately 0.17 inches from the distal end of the muzzle device. It will be readily appreciated that while five slot openings 30 are contemplated by the present invention, more or less than five slot openings 30 may also be used.

Each chamber 16,18 has filleted edges 32 where the interior walls of the housing 12 meet the ends of each chamber 16,18. These filleted edges provide for increased strength of the muzzle device 10 as a whole and minimize areas of potential weakness.

As shown in FIGS. 7-9, the forward end of the muzzle device 10 opposite the threaded engagement means 14 features a chamfered edge 34 that opens to allow for the exit of a projectile (not shown). In the preferred embodiment, the chamfered edge 34 forms an angle of approximately 45 degrees with the longitudinal axis 24, although other chamfer configurations may be employed without departing from the scope of the present invention.

In operation, when the firearm is fired, the projectile passes through the thread relief 15 and the first chamber 16. The propellant gases behind and pushing the projectile enter the thread relief zone 15 and are disrupted to retard gas movement. The propellant gases then enter the first chamber 16 partially exit through the five ports 20 before the majority of gas enters the large tapered cone of the second chamber 18 where the five slot openings 30 disperse the majority of the remaining propellant gases upwards and to the sides of the muzzle device 10. In particular, the five ports 20 direct high pressure gas over the corresponding five slot openings 30 of the larger tapered cone of the second chamber 18, such that as the accumulation of hot gases and sound energy following the projectile enter the second chamber 18, such gases are further dispersed radially away from the firing axis 24 through slot openings 30. As will be readily appreciated, the slot openings 30 allow passage of powder gases such that they exit from the second chamber 18 upward and to the sides, but not at the bottom of the muzzle device.

Importantly, the ports 20 and slot openings 30 are configured and positioned substantially along the top half of the muzzle device 10 such that the gases are substantially prevented from exiting the muzzle device 10 in a downwards direction. Such a port configuration prevents a dust signature from being created by shooting the firearm close to the ground. In addition, venting the powder gases in a generally upward, vertical direction reduces the recoil of the firearm, as well as aids in reducing muzzle climb.

As noted above, the five oblique ports 20 in the first chamber 16 direct the initial high-pressure gases forward and over the top of the larger elongated slot openings 30 of the second chamber 18. This is done to bias the powder gases from the second chamber forward and upward, away from the shooter and away from anyone to the sides of the shooter, which reduces the noise signature for the shooter and concussion and noise for those to the side of the firearm. These five oblique ports 20 also disrupt the gases from the slot openings 30 and disperse them quicker than existing designs, thereby reducing the flash signature of the firearm and help prevent secondary flash or "blooming."

Figure 20:
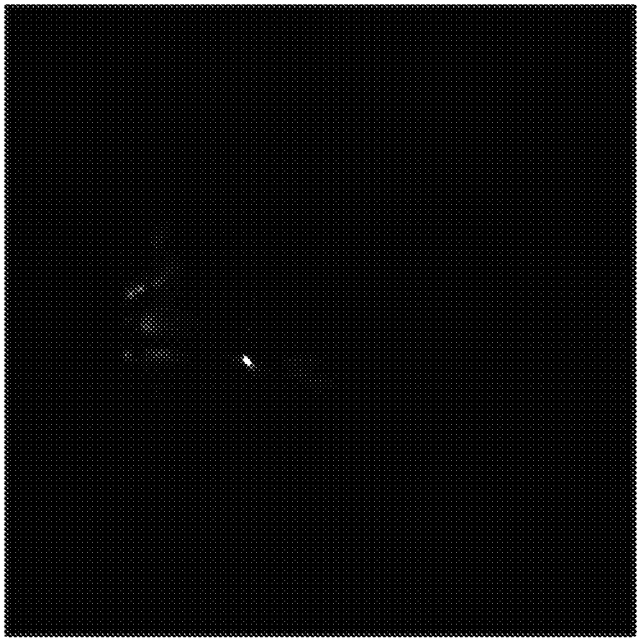
FIG. 20 is a high-speed movie picture showing the flash signature of the muzzle device of FIG. 7.
Figure 21:
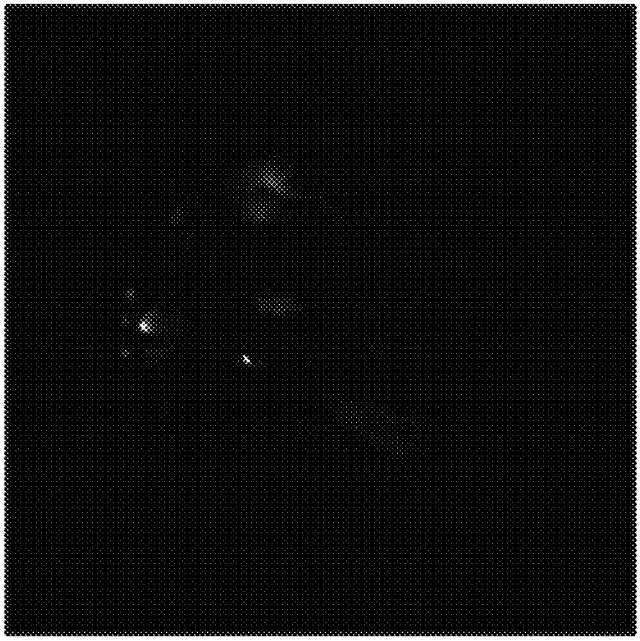
FIG. 21 is a high-speed movie picture showing the flash signature of the muzzle device of FIG. 7.

Turning now to FIGS. 20 and 21, the flash signature of an M4 firearm employing the muzzle device 10 in accordance with the preferred embodiment is shown. As shown therein, the flash signature of an M4 firearm employing the muzzle device 10 is greatly reduced as compared to the flash signature shown in FIGS. 3-6 of the prior art muzzle device 102 shown in FIGS. 1 and 2. In particular, as shown in FIGS. 20 and 21, there is substantially no secondary flash (in contrast to the secondary flash of the prior art muzzle device shown in FIG. 5) and the time duration of the flash event is substantially cut in half. As will be readily appreciated, these features provide an advantage to the operator and to those in the vicinity of the firing of the firearm.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of this disclosure.

What is claimed is:

1. A flash suppressor for a firearm having a barrel with a muzzle end, said flash suppressor comprising:

a housing mountable on said muzzle end of said barrel and defining a first chamber positionable adjacent to said muzzle end, and a second chamber positioned adjacent to said first chamber, said first and second chambers surrounding an axis extending longitudinally along said housing;

a plurality of ports located in said housing and providing fluid communication directly between said first chamber and the ambient;

a plurality of elongate slot openings positioned in said housing and providing fluid communication directly between said second chamber and the ambient, each of said slot openings having a longitudinal aspect oriented along said axis, each of said slot openings being longitudinally aligned with a respective one of said ports, said ports being angularly oriented toward said second chamber with respect to said axis to direct high pressure gas over said slot openings.

2. The flash suppressor according to claim 1, further comprising a third chamber defined by said housing and positioned adjacent to said first chamber, said third chamber having a larger diameter than said first chamber.

3. The flash suppressor according to claim 1, further comprising a circumferentially extending groove positioned in said housing, each of said ports having an exit opening positioned within said groove.

4. The flash suppressor according to claim 1, wherein each of said ports has an orientation angle of 50° measured relatively to said axis.

5. The flash suppressor according to claim 1, further comprising five of said ports and five of said slot openings.

6. The flash suppressor according to claim 5, wherein said ports are arranged around said housing at angular intervals of 30° relative to one another.

7. The flash suppressor according to claim 6, wherein said slot openings are arranged around said housing at angular intervals of 30° relative to one another.

8. The flash suppressor according to claim 1, wherein said second chamber has a first section having a cylindrical shape, and a second section having a cone shape, said first section being positioned between said first chamber and said second section.

9. The flash suppressor according to claim 1, wherein said first chamber is shorter than said second chamber.

10. The flash suppressor according to claim 1, wherein said ports are arranged in a single row extending around said housing.

11. A flash suppressor for a firearm having a barrel with a muzzle end, said flash suppressor comprising:

a housing mountable on said muzzle end of said barrel and defining a first chamber positionable adjacent to said muzzle end, and a second chamber positioned adjacent to said first chamber, said first and second chambers surrounding an axis extending longitudinally along said housing;

at least one port located in said housing and providing fluid communication directly between said first chamber and the ambient;

at least one elongate slot opening positioned in said housing and providing fluid communication directly between said second chamber and the ambient, said at least one slot opening having a longitudinal aspect oriented along said axis, said at least one slot opening being longitudinally aligned with said at least one port, said at least one port being angularly oriented toward said second chamber with respect to said axis to direct high pressure gas over said at least one slot opening.

12. The flash suppressor according to claim 11, further comprising a third chamber defined by said housing and positioned adjacent to said first chamber, said third chamber having a larger diameter than said first chamber.

13. The flash suppressor according to claim 11, further comprising a circumferentially extending groove positioned in said housing, said at least one port having an exit opening positioned within said groove.

14. The flash suppressor according to claim 11, wherein said at least one port has an orientation angle of 50° measured relatively to said axis.

15. The flash suppressor according to claim 11, further comprising five of said ports and five of said slot openings.

16. The flash suppressor according to claim 15, wherein said ports are arranged around said housing at angular intervals of 30° relative to one another.

17. The flash suppressor according to claim 16, wherein said slot openings are arranged around said housing at angular intervals of 30° relative to one another.

18. The flash suppressor according to claim 11, wherein said second chamber has a first section having a cylindrical shape, and a second section having a cone shape, said first section being positioned between said first chamber and said second section.

19. The flash suppressor according to claim 11, wherein said first chamber is shorter than said second chamber.

20. The flash suppressor according to claim 15, wherein said ports are arranged in a single row extending around said housing.

21. A firearm having a flash suppressor, said firearm comprising:

a barrel having a muzzle end;

a housing mounted on said muzzle end of said barrel and defining a first chamber positioned adjacent to said muzzle end, and a second chamber positioned adjacent to said first chamber, said first and second chambers surrounding an axis extending longitudinally along said housing;

a plurality of ports located in said housing and providing fluid communication directly between said first chamber and the ambient;

a plurality of elongate slot openings positioned in said housing and providing fluid communication directly between said second chamber and the ambient, each of said slot openings having a longitudinal aspect oriented along said axis, each of said slot openings being longitudinally aligned with a respective one of said ports, said ports being angularly oriented toward said second chamber with respect to said axis to direct high pressure gas over said slot openings.

22. The firearm according to claim 21, further comprising a third chamber defined by said housing and positioned adjacent to said first chamber, said third chamber having a larger diameter than said first chamber.

23. The firearm according to claim 21, further comprising a circumferentially extending groove positioned in said housing, each of said ports having an exit opening positioned within said groove.

24. The firearm according to claim 21, wherein each of said ports has an orientation angle of 50° measured relatively to said axis.

25. The firearm according to claim 21, further comprising five of said ports and five of said slot openings.

26. The firearm according to claim 25, wherein said ports are arranged around said housing at angular intervals of 30° relative to one another.

27. The firearm according to claim 26, wherein said slot openings are arranged around said housing at angular intervals of 30° relative to one another.

28. The firearm according to claim 21, wherein said second chamber has a first section having a cylindrical shape, and a second section having a cone shape, said first section being positioned between said first chamber and said second section.

29. The flash suppressor according to claim 21, wherein said first chamber is shorter than said second chamber.

30. The flash suppressor according to claim 21, wherein said ports are arranged in a single row extending around said housing.

31. The firearm according to claim 21, wherein said firearm comprises a rifle.

* * * * *